United States Patent [19]

Walsh

[11] Patent Number: 4,834,084

[45] Date of Patent: May 30, 1989

[54] SELF-DRAINING SNORKEL

[76] Inventor: Mark L. Walsh, 5016 W. Windsor, Chicago, Ill. 60630

[21] Appl. No.: 722,335

[22] Filed: Jul. 31, 1985

Related U.S. Application Data

[63] Continuation of Ser. No. 499,844, Jun. 1, 1983, abandoned.

[51] Int. Cl.[4] ..... A62B 7/00
[52] U.S. Cl. ..... 128/201.11
[58] Field of Search ..... 128/201.11

[56] References Cited

U.S. PATENT DOCUMENTS

| | | | |
|---|---|---|---|
| 2,317,236 | 4/1943 | Wilen et al. | 128/201.11 |
| 3,860,042 | 1/1975 | Green | 128/201.11 |
| 4,066,077 | 1/1978 | Shamlian | 128/201.11 |
| 4,071,024 | 1/1978 | Blanc | 128/201.11 |
| 4,278,080 | 7/1981 | Schuch | 128/201.11 |

FOREIGN PATENT DOCUMENTS

| | | | |
|---|---|---|---|
| 927661 | 11/1947 | France | 128/201.11 |

OTHER PUBLICATIONS

Dacor, "Dacor Self Draining Snorkel", (1 pg). On sale prior to June 1982.

Scuba Pro, "Snorkels, Super Set Snorkel", (1 pg). 1972 Catalog.

Tabata USA Inc, "Color Me Bright", Skin Diver Magazine, May 1984 (1 pg.).

Dacor, "Dacor's Turbo Vent II Silicone Contour Snorkel", Skin Diver Magazine, Jul. 1984 p. 129.

*Primary Examiner*—Edward M. Coven
*Assistant Examiner*—K. M. Reichle

[57] ABSTRACT

A vented diving snorkel from which water is drained as the open upper end of the snorkel tube is raised out of the water includes a combined drain and sump section which is located below the mouthpiece and which is separated from the snorkel tube by a baffle which directs fluid away from the drain section and up the main snorkel tube when the diver exhales abruptly through the mouthpiece. Being located below the mouthpiece, the drain section provides a sump into which the small amount of water not expelled from the snorkel and the water which splashes into the open upper end of the snorkel drains.

4 Claims, 1 Drawing Sheet

SELF-DRAINING SNORKEL

This is a continuation of application Ser. No. 06/499,844, filed June 1, 1983, now abandoned.

The present invention relates in general to diving snorkels which include a port through which water is drained from the snorkel as the open end of the snorkel is raised above the surface, and it relates in particular to a new and improved self-draining snorkel which employs a combined sump and drain section located below the mouthpiece of facilitate expulsion of water from the main snorkel tube and to collect any water which flows down the snorkel tube at a location displaced from the breathing passageway through the snorkel.

BACKGROUND OF THE INVENTION

When snorkeling, a diver normally retains the mouthpiece in his mouth while keeping the upper end of the snorkel tube above the water surface to enable him to inhale fresh air through the snorkel and to exhale out through the snorkel. The most common prior art type snorkels had a mouthpiece connected to a relatively long snorkel tube by a U-shaped tubular section. Any water or saliva which may find its way into this prior art type snorkel will drain to the lowest point in the snorkel tube, i.e., the bottom of the U-shaped section, and unless the passageway through the tube becomes completely filled by this liquid, fresh air will be drawn across the surface of the liquid when the diver inhales. Even if a short length of the U-shaped section is completely filled with the liquid, it is still possible for the diver to breath through the snorkel. However, breathing across or through a body of liquid trapped in the snorkel tube is at best an annoyance, and it is particularly annoying to the novice or infrequent snorkeler.

When a snorkeler dives below the surface, the snorkel will be completely filled with water and cannot be used for breathing until it has been cleared of the water. The most common method of "clearing" a snorkel is for the diver to lift the open end of the snorkel above the surface and then to blow sharply into the mouthpiece to force the water of the snorkel. Ordinarily, the diver maintains his face in the water while clearing the snorkel. It is well known to provide a drain port in the wall of the snorkel tube and to mount a one-way valve across the drain port to automatically drain water from the snorkel as the diver comes to the surface and the open end of the snorkel is raised above the surface. In the many different self-draining snorkels which have been designed and marketed, the drain ports have been connected to the main snorkel tube at locations above the mouthpiece, below the mouthpiece, and about level with the mouthpiece. It is also known in the prior art to connect the mouthpiece to an intermediate location on a snorkel tube having a one-way valve at the bottom and an open end at the top. In the latter type of snorkel water which splashed into the snorkel tube drained past the mouthpiece tube into the bottom of the snorkel tube. Such sorkels are more difficult to clear than are the simple non-draining snorkels, but they have the advantage of keeping the breathing passageway relatively clear of water or other liquid.

SUMMARY OF THE INVENTION

Briefly, there is provided in accodance with the present invention a diving snorkel which is provided with a comined sump and drain section located below the mouthpiece and at a location displaced from the breathing passageway through the snorkel. A one-way drain valve is located near one end of the sump and drain section with the other end opening into the main snorkel tube at the lowest point therein whereby any water or other liquid which enters the snorkel tube during use thereof drains into the sump and drain section to maintain the breathing passageway completely free of liquid. A baffle or other fluid directing surface is provided between the mouthpiece and the opening to the sump and drain section to direct air and liquid up into the main snorkel tube and away from the drain and sump section when a sharp burst of air is blown into the mouthpiece while the snorkel tube is substantially filled with water. As a result complete clearing of the snorkel can be achieved since the air does not bypass the main snorkel tube and exit through the sump and drain section without expelling substantially all of the water from the snorkel tube.

In accordance with another improved feature of the present invention, the sump and drain section is tubular and parallel to the centerline of the snorkel, and a rotary connection is provided in the long, contoured leg of the snorkel tube to permit the snorkel to be used on either side of the heat and the angle thereof to be adjusted to the desires of the diver using it.

GENERAL DESCRIPTION OF THE DRAWING

The present invention will be better understood by a reading of the following detailed description taken in connection with the accompanying drawing wherein.

DETAILED DESCRIPTION OF A PREFERRED EMBODIMENT OF THE INVENTION

Figure 1:
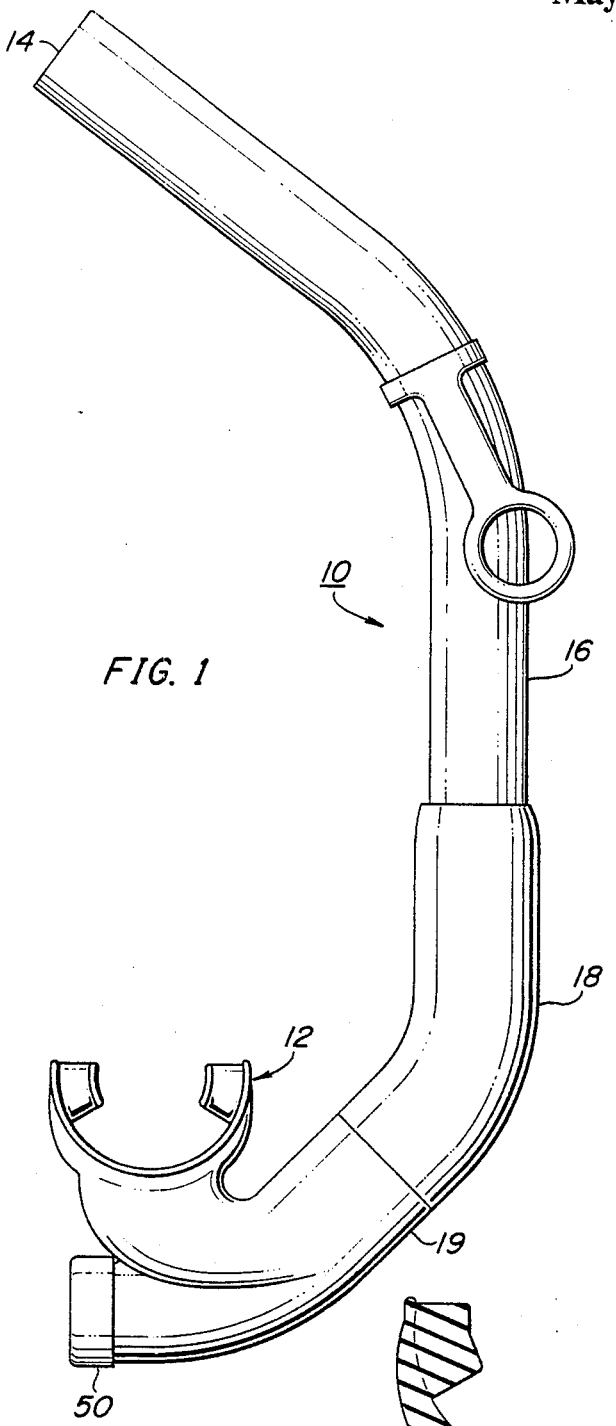
FIG. 1 is a view showing a snorkel embodying the present invention in a upright position.
Figure 3:
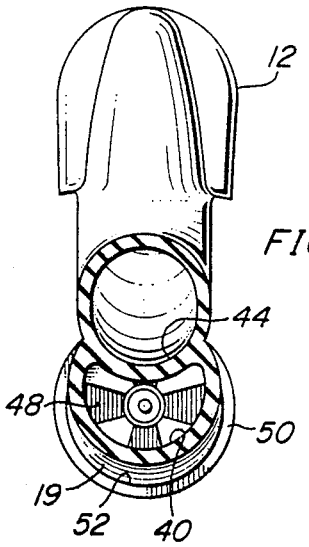
FIG. 3 is a cross-sectional view taken along the line 3—3 of FIG. 2.

Referring particularly to FIG. 1, a diving snorkel 10 is provided with a mouthpiece 12 which is adapted to be held in the mouth of the diver. The mouthpiece 12 is connected by a passageway through the snorkel to an open end 14 at the top. The upper portion of the snorkel is a bent or contoured tubular barrel member 16 which connects to a molded rubber, tubular section 18. The section 18 is rotatably connected to a generally U-shaped section 19 which extends between the mouthpiece 12 and the section 18. As more fully described hereinafter, a rotary connection is provided between the sections 18 and 19 to permit the diver to adjust the position of the barrel 16 so that it best fits the contour of his or her head.

Figure 2:
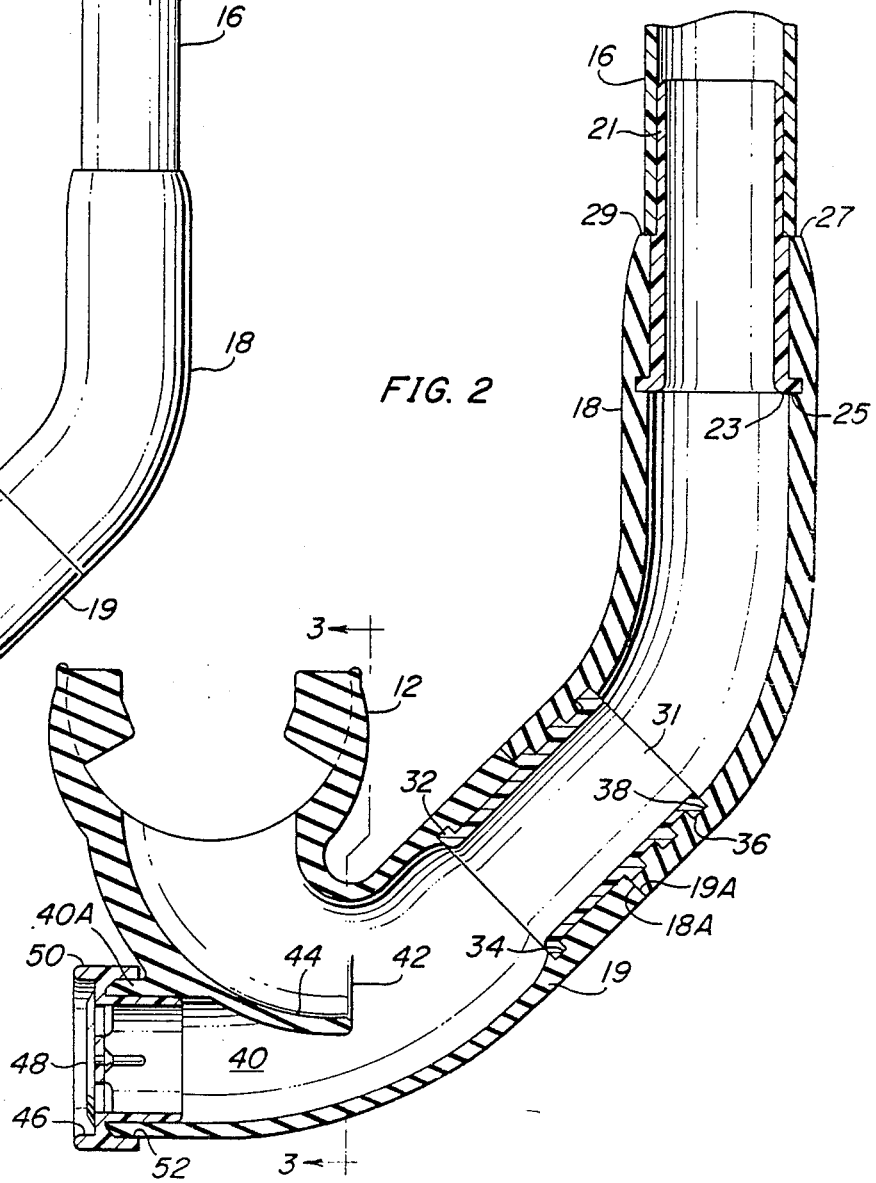
FIG. 2 is an enlarged longitudinal cross-sectional view of the lower portion of the snorkel shown in FIG. 1.

Referring particularly to FIG. 2, it may be seen that the barrel tube 16 is connected to the section 18 by means of a connector sleeve 21 having an external flange 23 at the bottom which fits tightly into an annular groove 25 in the inner wall of the section 18. The sleeve 21 has an annular shoulder 27 which lies flush with the upper end 29 of the snorkel section 18 and the lower end of the barrel tube 16 fits tightly against both the shoulder 27 and the end surface 29. Moreover, the tube 16 is tightly and sealably fitted onto the upper portion of the connector sleeve 21, and if desired, may be bonded thereto.

An adjustable, rotatable connection is provided between the snorkel sections 18 and 19 by means of a sleeve 31 which has an external annular flange 32 which fits into an annular groove 34 in the internal wall of the section 19. The sleeve 31 also includes a plurality of spaced annular ribs 36 which tightly fit into respective annular grooves 38 in the wall of the tubular section 18. It may be seen that the upper end 19A of the section 19 abuts the lower end 18A of the section 18. The three annular ribs 36 permit rotation of the section 18 relative to the section 19 without permitting fluid to leak into or out of the snorkel at the junction of the sections 18 and 19.

The portion of the snorkel which connects the mouthpiece 12 to the upwardly extending portion of the snorkel is substantially J-shaped. It will be understood that in some snorkels the barrel tube 16 may be a straight tube without having a bend or contour therein.

In accordance with an important feature of the present invention, the snorkel 10 includes a sump and drain section 40 which is located below the mouthpiece 12 and below the breathing passageway through the snorkel. The section 40 communicates with the upwardly extending portion of the snorkel as well as the U-shaped portion thereof by a generally elliptical opening 42. The drain and the sump section is separated from the main breathing passageway through the snorkel by a curved wall or baffle section 44 which functions to direct fluid away from the sump and drain section during clearing of the snorkel when the diver blows sharply into the snorkel through the mouthpiece 12. In this embodiment of the invention the sump and drain section 40 is elongated in the form of a conduit having at its distal end an outlet port 46 which opens to the ambient. A check valve 48 is mounted across the outlet port and functions to prevent fluids from entering the snorkel through the port 46. The volume of the sump and drain section 40 is not critical but should be sufficiently large so that the water which splashes into the snorkel during normal use may be collected in the section 40 away from the normal passageway through which air passes through the snorkel during inhalation by the diver.

The section 19 may be a single molded rubber or plastic part which includes the mouthpiece 12 and the drain and sump section 40. A valve housing member 50 to which the valve member 48 is attached includes an annular groove 52 into which the end portion 40A of the sump and drain section 40 is tightly fitted to provide a fluid tight seal as well as a good mechanical connection between the valve housing 50 and the snorkel 19. The section 18 may also be a molded rubber part with the connector sleeves 21 and 31 preferably being rigid molded plastic parts.

OPERATION

During normal use when a diver is snorkeling along the surface of the water with his face submerged and with the upper end 14 of the snorkel located above the surface of the water, the diver may breath fresh air in through the snorkel and exhale spent air out through the snorkel. Since the external pressure on the valve 48 exceeds atmospheric pressure to which the end 14 of the snorkel opens, the valve 48 remains closed. Any water which may splash into the snorkel or any siliva from the diver's mouth which may drain into the snorkel through the mouthpiece will flow down into the sump and drain section 40 where it collects. Inasmuch as the sump and drain section is below the breathing passageway through the snorkel, it has no effect on the breathing of the diver and, in fact, the diver will not know whether or not liquid is present in the sump.

When the diver down below the surface of the water so that the open end 14 becomes submerged, the snorkel will become filled with water. Thereafter, if the diver wishes to commence breathing, he must swim to the surface and position the top end 14 of the snorkel above the surface of the water. He can then exhale sharply into the snorkel through the mouthpiece to blow the column of water in the breathing passageway through the snorkel out through the top end 14. As the column of water is moving up through the snorkel tube a force will also be exerted to expel the water in the sump and drain section 40 through the outlet 46. Assuming that the pressure exerted by the diver is greater than the ambient pressure on the valve 48, the valve 48 opens and the drain and sump section also is cleared of water by the time that the column of water in the main snorkel has cleared the end 14. The snorkel is now substantially free of water and may again be used for normal breathing by the diver. Any water which was not completely cleared from the snorkel will drain back along the walls of the sections 16, 18 and 19 and flow into the sump and drain section 40. Ordinarily, less than one ounce of water will return to the section 40. Therefore, by dimensioning the section 40 to have a capacity of one ounce or more, the breathing passageway will remain substantially dry and free of water except when the diver swims below the surface to submerge the end 14.

While the particular shape of the wall or baffle 44 is not critical, it is important that it be shaped so as to direct the air and fluid flowing from the mouthpiece during clearing away from the sump and drain section 40 and into the main upwardly extending snorkel tube. Also, for the section 40 to function as a sump in which water is collected out of the breathing passageway, it is important that it be located below the normal breathing passageway. The wall or baffle 44 has been found to greatly facilitate clearing of the snorkel, and the sump and drain section being located below the lowermost point of the breathing passageway has been found to result in a very dry breathing snorkel.

While the present invention has been described in in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A diving snorkel comprising in combination, an elongated snorkel tube including a generally U-shaped section having first and second upwardly directed open ends and a long leg section having first and second open ends, the second open end of said long leg section being below said first open end of said long leg section, the second open end of said U-shaped section being connected to the second open end of said long leg section, a mouthpiece connected over the first open end of said generally U-shaped section, the first open end of said long leg section being open to the atmosphere, an elongated combined sump and drain conduit section having first and second open ends and being disposed directly below said U-shaped section and said mouthpiece, said U-shaped section having an inlet port in the bottom surface thereof, the first open end of said sump and drain conduit section being connected to the inlet port of said U-shaped section, said combined sump and drain section having an outlet port at said second open end disposed below said mouthpiece, one-way valve means mounted to said sump and drain section across said outlet port for permitting fluid to flow out of said snorkel tube through said outlet port while preventing liquid from flowing into said snorkel through said outlet port, and the portion of said combined sump and drain conduit section adjacent the portion of the bottom surface of said U-shaped section located directly below the mouthpiece being integral therewith to define a common wall which separates them from one another, said common wall being configured to provide a baffle to direct fluid flowing through said U-shaped section from said mouthpiece past said inlet port into said long leg section while permitting liquid within said sump and drain section to flow in a direction generally opposite to the flow of the fluid within said U-shaped section from said mouthpiece and out of said snorkel tube through said outlet port.

2. A diving snorkel according to claim 1 comprising a rotary connection between said U-shaped section and said long leg section.

3. A diving snorkel according to claim 1 wherein said outlet port is displaced from the vertical center line of said mouthpiece.

4. A diving snorkel comprising in combination, an elongated snorkel tube including a generally U-shaped section having first and second open ends and a long leg section having first and second open ends, the second open end of said U-shaped section connected to the second open end of said long leg section, a mouthpiece connected over the first open end of said generally U-shaped section, the first open end of said long leg section being open to the atmosphere, an elongated combined sump and drain conduit section having first and second open ends disposed directly below said U-shaped section and said mouthpiece and extending in a direction substantially tangential to the bottom surface of said U-shaped section and perpendicular to the vertical center line of said mouthpiece, said U-shaped section having an inlet port in the bottom surface thereof, the first open end of said sump and drain conduit section connected to the inlet port of said U-shaped section, said conbined sump and drain section having an outlet port at said second open end disposed below said mouthpiece, one-way valve means mounted to said sump and drain section across said outlet port for permitting fluid to flow out of said snorkel tube through said outlet port while preventing liquid from flowing into said snorkel through said outlet port, and the portion of said combined sump and drain conduit section adjacent the portion of the bottom surface of said U-shaped section located directly below the mouthpiece being integral therewith to define a common wall which separates them from one another, said common wall being configured to provide a baffle to direct fluid flowing through said U-shaped section from said mouthpiece past said inlet port into said long leg section.

* * * * *